US005277048A

United States Patent [19]

Lubas

[11] Patent Number: 5,277,048

[45] Date of Patent: Jan. 11, 1994

[54] PROCESS AND APPARATUS FOR TREATING THE SURFACE OF AN ELONGATED, STEEL ALLOY FORM TO FACILITATE COLD WORKING THEREOF

[75] Inventor: Michael J. Lubas, Reading, Pa.

[73] Assignee: CRS Holdings, Inc., Wilmington, Del.

[21] Appl. No.: 979,186

[22] Filed: Nov. 20, 1992

[51] Int. Cl.[5] ..... B21J 1/00; B24C 5/00

[52] U.S. Cl. ..... 72/53; 72/319

[58] Field of Search ..... 72/53; 29/90.7; 51/319, 51/320

[56] References Cited

U.S. PATENT DOCUMENTS

| | | | |
|---|---|---|---|
| 1,914,587 | 6/1933 | Wise | 72/53 |
| 2,239,044 | 12/1938 | Leighton | 72/53 |
| 4,258,084 | 3/1981 | Hayden, Sr. | 72/53 |

FOREIGN PATENT DOCUMENTS

| | | | |
|---|---|---|---|
| 2386390 | 12/1978 | France | 72/53 |
| 0020319 | 2/1983 | Japan | 72/53 |
| 0290621 | 11/1990 | Japan | 72/53 |
| 2175611 | 12/1986 | United Kingdom . | |

OTHER PUBLICATIONS

M. Woelfel et al., "Glass Bead Impact Blasting", Metal Progress (Sep. 1982).

J. V. Skoff, "Lubricant Retention A Key to Better Tool Performance", Metal Stamping (Sep. 1986).

H. Steele Price, III. "Update on wet blast descaling and in-line coating", Wire Journal International (May 1985).

T. Fukuda et al., "In-Line phosphate coating method of cold-forging wire", Wire Journal International (Jul. 1985).

*Primary Examiner*—David Jones

*Attorney, Agent, or Firm*—Dann, Dorfman, Herrell and Skillman

[57] ABSTRACT

A process for cold working an elongated form of a steel alloy includes the step of forming a matte texture on substantially all of the surface of the elongated form. The matte texture is characterized by a plurality of random, minute, shallow indentations, uniformly distributed on the elongated form's surface. The process provides an elongated form of steel alloy that has a significantly improved capability to carry lubricant into a cold working tool or die, thereby benefiting the cold workability of the elongated form. An apparatus for carrying out the process according to the invention, in line with one or more other processing operations is also disclosed.

27 Claims, 5 Drawing Sheets

PROCESS AND APPARATUS FOR TREATING THE SURFACE OF AN ELONGATED, STEEL ALLOY FORM TO FACILITATE COLD WORKING THEREOF

BACKGROUND OF THE INVENTION

This invention relates to processes for cold working an elongated form of a steel alloy, and in particular to a process and apparatus for treating the surface of such an article to facilitate cold working thereof.

An elongated form of a steel alloy, such as wire, rod, or bar, can be cold worked to provide useful product sizes and shapes. Here and throughout this application, the term "cold working" means the plastic deformation of metal under conditions of temperature and strain rate that result in strain hardening of the metal and which is typically, but not necessarily conducted at room temperature. Cold working of an elongated form includes such operations as drawing, extruding, cold heading, or a combination thereof. Prior to being cold worked, an elongated form of steel alloy is treated to remove surface conditions such as oxide scale or residue that result from upstream processing, e.g., hot or cold rolling. As a result of such pre-cold-work processing, a smooth surface is formed on the elongated, steel alloy form.

One of the known processes for providing a smooth surface on the elongated steel form is the removal of a thin peripheral layer of material by shaving, peeling, or broaching the elongated, steel alloy form. Here and throughout this application, the term "shaving" includes any operation that is also commonly referred to as "scalping". The shaving, peeling, or broaching process exposes a new surface on the steel alloy form that is very smooth and reflective. Steel wire that has been previously cold-worked can be bright strand annealed prior to further cold working. Such processing also leaves a very smooth and highly reflective surface on the wire.

An elongated steel alloy form having a smooth, reflective surface is difficult to cold work because such a surface is not conducive to carrying lubricant into the cold working tool or die. Consequently, the elongated form of steel alloy is subject to scratching or galling and the cold working tool or die is subject to damage.

Some machines that perform surface layer removal leave superficial, machine tool marks on the surface of the elongated form. These tool marks act as high pressure points that also adversely affect the drawability or extrudability of the steel alloy form. Tool marks that are left on the surface of the elongated form can remain visible after cold working and present an unsightly appearance.

After the surface layer removal process, steel alloy bar, wire, or rod has been treated by acid etching, annealing, and then acid cleaning, or by annealing, shot blasting, and then acid dipping, to provide a dull, etched surface that is more conducive to retaining lubricant during a subsequent cold working operation. However, the use of acids to provide surface etching and scale removal leaves much to be desired for a number of reasons. Acids are highly corrosive and are difficult to dispose of in an environmentally safe manner. Acid cleaning is not readily adaptable to in-line or strand processing. Furthermore, many steel alloys are subject to intergranular attack when the surface is acid cleaned.

The use of shot blasting with metallic shot to treat the surface of an elongated steel alloy form also leaves much to be desired. Shot blasting work hardens the surface of such forms which adversely affects their cold-workability. Also, shot blasting leaves a metallic residue on the surface which can cause corrosion unless it is removed by acid cleaning. The drawability and extrudability of an elongated steel alloy form are adversely affected when the surface is excessively cratered and torn by the shot blasting process. Furthermore, the surface indentations provided by shot blasting are relatively sharp, jagged voids that can easily trap lubricant, precoat, or coolant used during the cold working process. During elevated temperature thermal treatment of the elongated form after cold working, localized corrosive attack can occur in the indentations, thereby resulting in undesirable surface pitting.

Apparatus for shot blasting is relatively massive and is not conducive to in-line or single strand processing. Also, a significant amount of energy is required to operate a shot blasting apparatus because shot blasting is an airless process that uses a large centrifugal wheel to propel the metal shot.

Another known method of enhancing the cold-workability of an elongated steel alloy form is to coat it with a thin layer of a more malleable material such as copper. Although copper coating can significantly enhance the cold-workability of many steel alloys, the coating must ultimately be removed from the cold-worked product. The removal of the copper coating is costly and poses significant problems in connection with environmental safety because it requires the use of highly corrosive chemicals.

Air-driven abrasive media such as sand, aluminum oxide, or glass beads have been used for treating the surface of a metal article to remove oxide scale, paint, or dry surface residues and to condition the metal surface for good adhesion of a paint or coating. In particular, air-driven glass beads have been used for peening metal surfaces to provide a beneficial compressive stress in the peened surface layer. Air-driven glass beads have also been used to provide a dull or matte finish on steel alloy strip that was flat-rolled from round wire.

SUMMARY OF THE INVENTION

The problems associated with the known processes for cold working an elongated steel alloy form, such as wire, rod, or bar, are solved to a large degree in accordance with one aspect of this invention, whereby there is provided a novel process for cold working an elongated form of a steel alloy which has a smooth, reflective surface. The cold working process includes the steps of forming a matte texture on substantially all of the surface of the elongated form, applying a lubricant to the elongated form such that the lubricant contacts the matte textured surface, and then cold working the elongated form. The matte texture is characterized by a plurality of random, minute, shallow indentations, formed over substantially all of the surface of the elongated steel form. The matte texture significantly increases the lubricant retention capability of the surface of the elongated form, thereby facilitating cold working of the elongated form.

In accordance with another aspect of this invention there is provided a process for treating an elongated form of a steel alloy, such as wire, rod, or bar, to facilitate cold working of the elongated form. The process according to this aspect of the present invention includes forming a smooth, reflective surface on the elongated form of steel alloy, and then forming the above-described matte texture on substantially all of the surface of the elongated form.

In accordance with a further aspect of this invention there is provided an apparatus for treating the surface of an elongated form of a steel alloy to facilitate cold working thereof. The apparatus includes means for forming a smooth, reflective surface on the elongated form, surface texturing means for forming a matte texture comprising a plurality of random, minute indentations on substantially all of the surface of the elongated form, and means for pulling the elongated, steel alloy article longitudinally through said smooth, reflective surface forming means and said surface texturing means.

BRIEF DESCRIPTION OF THE DRAWINGS

The foregoing summary, as well as the following detailed description of the process and apparatus according to the present invention, will be better understood when read in connection with the appended drawings, wherein.

DETAILED DESCRIPTION

Figure 1:
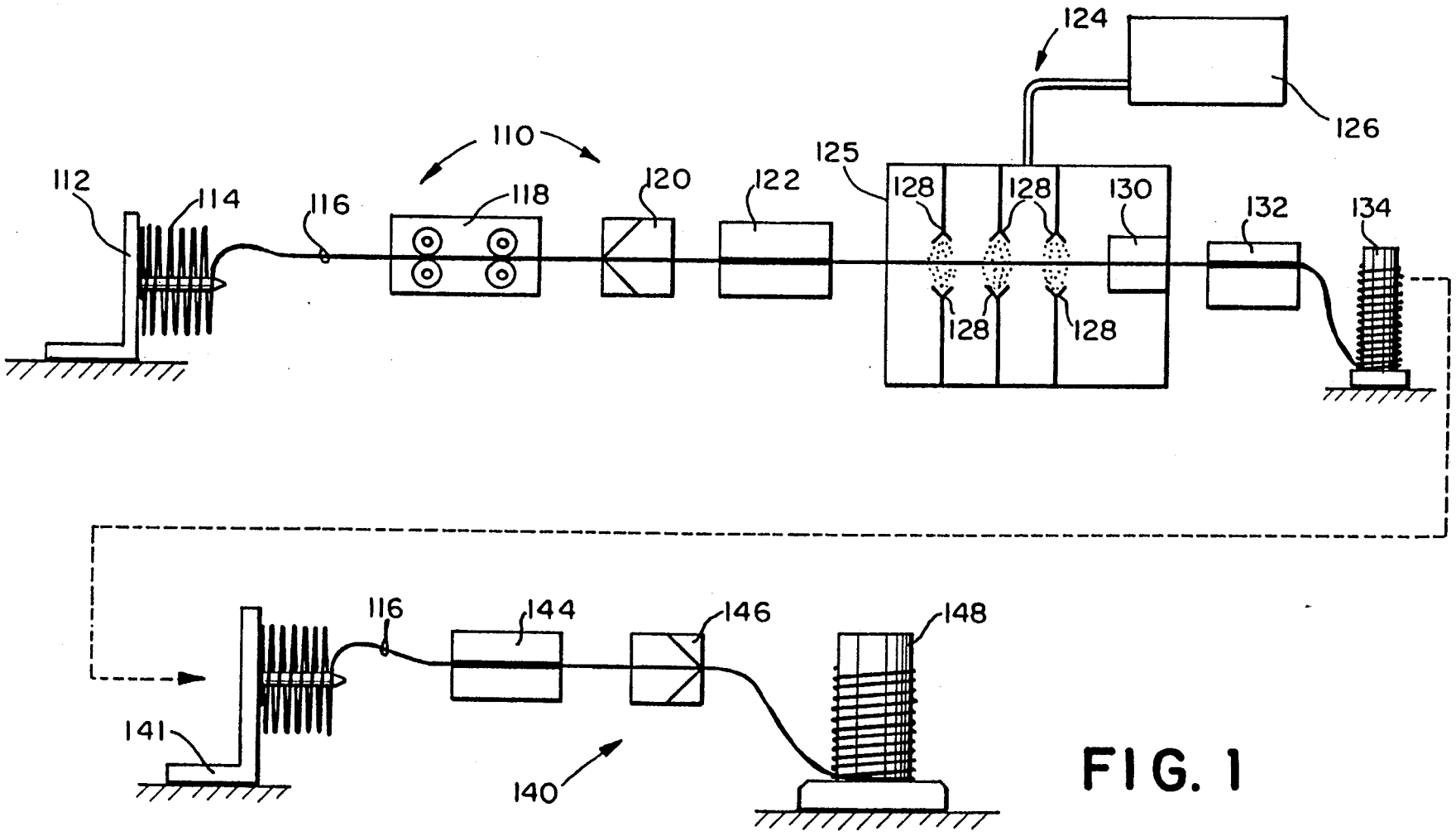
FIG. 1 is a schematic diagram of a surface treating and cold working apparatus in accordance with the present invention.

In the method according to the present invention a smooth, reflective finish is formed on the surface of an intermediate size of an elongated, steel alloy form, such as wire, rod, or bar. Among the known operations for providing such a surface are shaving, peeling, broaching, or back-die shaving. In such an operation a thin, peripheral layer of material is removed from the surface of the elongated form of steel alloy. Another technique that provides a suitable surface is bright annealing of wire or rod that has been cold drawn. Bright strand annealing is a preferred bright annealing technique because it is readily adaptable to in-line processing.

After the smooth surface is formed on the elongated steel alloy form, a matte texture is formed on substantially all of the surface of the elongated steel alloy form so as to provide uniform coverage thereon. The matte texture is characterized by a plurality of random, minute, shallow indentations, uniformly covering the surface of the elongated form. The randomness of the indentations is important because directional indentations, such as longitudinal lines or circumferential spirals, are significantly less effective for carrying lubricant into and through a cold working tool. The coarseness of the matte texture also is important because if the matte texture is too fine or too coarse, lubricant will not properly adhere to the surface of the elongated form. Preferably the roughness of the matte textured surface is about 30 to 50 microinches Ra. The step of providing the matte texture is preferably performed in-line with one or more of the surface smoothing processes, such as back-die shaving or bright strand annealing. Such in-line processing provides a very efficient mode of surface treating an elongated form that is to be subsequently cold-worked.

In carrying out the surface texturing step of the present invention, minute, nonmetallic, nonporous, spheroidal particles are propelled at high velocity onto the surface of the elongated, steel form. The spheroidal particles impinge on the surface of the elongated, steel form to produce the random, minute, shallow indentations that are characteristic of the desired matte texture. Here and throughout this application the term "spheroidal" means a shape that is regularly or irregularly rounded and does not include sharp angles. The term "spheroidal" encompasses, but is not limited to, round spheroids, oblate or prolate spheroids, ellipsoids, teardrop shapes, and pear shapes, as well as combinations thereof. The particles are preferably embodied as glass beads about 100–170 mesh in size.

The spheroidal particles are carried toward the surface of the elongated, steel form in a stream of fluid such as compressed air that is supplied from a high pressure source. Thus, the density of the spheroidal particles must be low enough to permit their being readily carried by a pressurized fluid, preferably by compressed air. The fluid stream is preferably supplied at about 60–100 psi in order to impart the desired high velocity to the spheroidal particles. In carrying out the process according to the present invention, the velocity of the spheroidal particles is controlled to provide the desired surface roughness without measurable peening or work-hardening of the surface of the elongated form. Work hardening of the surface of an elongated, steel alloy form adversely affects the cold workability of the elongated form. The particle velocity can be controlled by adjusting the pressure at which the carrier fluid is supplied. To obtain substantially full and uniform coverage of the elongated, steel form surface, it is preferred that a plurality of streams of the minute, nonmetallic, nonporous particles be used. As will be described in connection with a preferred apparatus according to this invention, the particle streams are arranged around the elongated form and each of the streams is angularly displaced from an adjacent stream around the elongated form and directed generally radially toward the elongated form.

After the matte texture is formed on the surface of the elongated form, and prior to further processing, a lubricant is applied to the elongated form. The lubricant is applied in any known manner so as to contact the matte surface of the elongated form, to which the lubricant readily adheres. Although any known lubricant that is suitable for cold working operations can be used, it is preferred that the lubricant be compatible with the particular cold drawing, cold extrusion, or cold heading process to be performed on the elongated, steel alloy form.

The lubricated form is then cold worked as by cold rolling, cold drawing, or cold extruding to reduce its cross-sectional area without removing material therefrom. Instead of, or in addition to, such cold reduction, the lubricated form can be cold headed. It will be readily appreciated, however, that the matte-textured, elongated form need not be cold worked immediately after the surface-texturing step. Rather, it can be sold as a finished or semifinished product form.

Referring now to FIG. 1 there is shown a schematic representation of an apparatus for carrying out the method according to the present invention. The apparatus includes a surface treating line 110 and a wire drawing line 140. In the surface treating line 110 a pay-off stand 112 supports a coil 114 of steel alloy wire 116. The surface treating line 110 includes an optional roller die 118, a surface layer removal tool 120, an air wipe 122, a surface texturing apparatus 124, a lubricant applicator 132, and a capstan 134. The Wire 116, before reaching the surface treating line 110, will have been processed as by hot or cold rolling to an intermediate size or diameter. The wire 116 is pulled by capstan 134, longitudinally through the optional roller die 118 and through the surface layer removal tool 120. If desired, a straightening die or a drawing die can be used in place of roller die 118. The surface layer removal tool 120 is a tool or machine that is designed to remove a thin surface layer of the wire 116. Depending on the nature of the elongated form, i.e., wire, rod, or bar, the surface layer removal tool 120 can be embodied as a broaching tool, a shaving tool, a peeling machine, or a back-die shaving tool. In the embodiment shown in FIG. 1, the surface layer removing tool is embodied as a back-die shaving tool. The surface layer removal tool 120 removes a thin peripheral layer of material from the surface of the wire 116, thereby exposing a new surface on the wire which is very smooth and reflective.

For some types of surface layer removal techniques, a coolant is applied to the wire 116 in order to control thermally induced stresses therein during the surface layer removal operation. The air wipe 122 removes any residual coolant from the wire 116 to provide a surface that is dry. The air wipe 122 can also be embodied as a vacuum device for removing the coolant from the wire surface.

After the air wipe 122, wire 116 passes through the surface texturing apparatus 124. The surface texturing apparatus 124 includes an enclosure 125, a reservoir 126 which holds the minute non-metallic, non-porous spheroidal particles, and a plurality of spray or blast nozzles 128. The surface texturing device 124 also includes means for mixing the particles from reservoir 126 with compressed air, preferably in the blast nozzles 128. The particles are propelled through the blast nozzles 128 by the compressed air, so as to impinge on the surface of the wire 116 as it passes through the enclosure 125. The blast nozzles 128 are arranged around the pass line of wire 116 through enclosure 125 such that the surface of the wire is fully and uniformly contacted by the particles.

Figure 2:
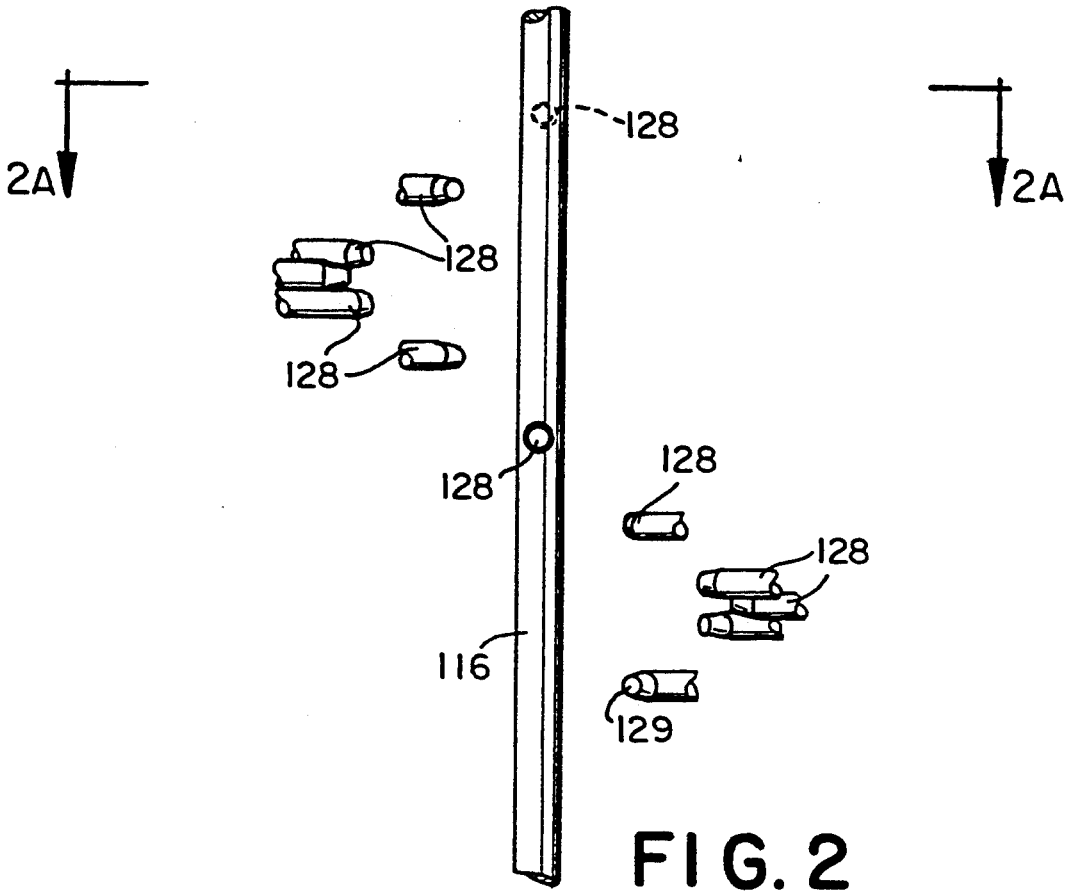
FIG. 2 is a plan or elevation view of the blast nozzle arrangement used in the surface texturing apparatus 124 shown in FIG. 1.
Figure 2A:
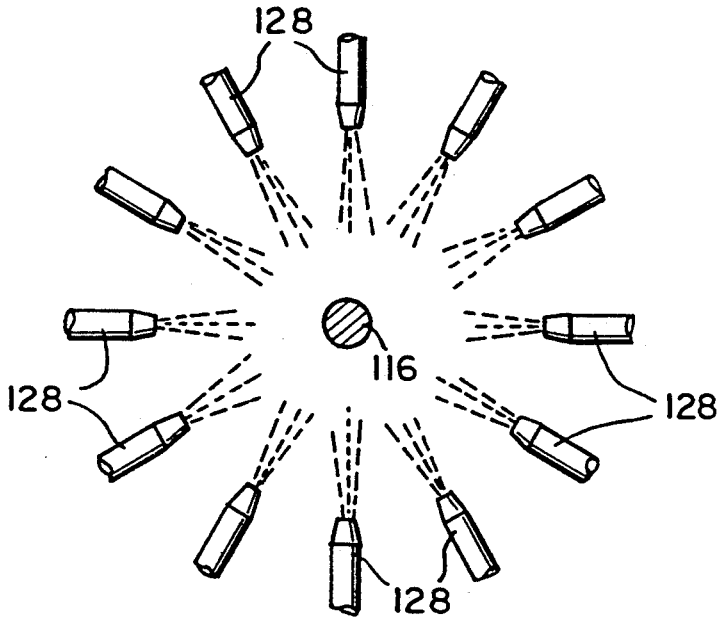
FIG. 2A is an end view of the blast nozzle arrangement of FIG. 2.

As shown in FIG. 2, the blast nozzles 128 are preferably arrayed in a helical pattern about the pass line of wire 116 to provide a plurality of particle streams. The preferred arrangement, shown in FIG. 2A, includes twelve nozzles each spaced a preselected radial distance from the pass line of wire 116 and each angularly displaced from an adjacent nozzle. The inside diameter of the orifice 129 of a blast nozzle 128 and the radial distance of the blast nozzle 128 from the wire 116 are selected such that, for a given air pressure, the velocity of the spheroidal particles at the surface of the wire 116 results in sufficient surface indentation to provide the desired surface roughness without any measurable peening or work-hardening of the wire surface. The surface texturing apparatus 124 can also include an air wipe 130 to remove dust or other residue on the wire 116 that results from the surface texturing process. Preferably, the surface texturing apparatus 124 and the surface layer removal tool 120 are aligned on a common axis, such that the pass line of the wire 116 through the surface layer removal tool 120 and the surface texturing apparatus 124 coincides with the common axis.

Upon exiting the surface texturing apparatus 124, the wire 116 passes through a lubricant applicator 132 and is coiled onto a capstan 134. The capstan 134 is powered and rotates to pull the wire 116 through the various devices on the surface treating line 110. It is readily apparent that wire 116 is subject to significant tension as it is pulled through the surface treating line 110. That tension is desirable to the extent that it helps keep the wire 116 on or very close to the common axis of the surface layer removal tool 120 and the surface texturing apparatus 124, and hence equidistant from the array of blast nozzles 128. Of course, the tension on wire 116 must be controlled so as not to exceed the tensile yield strength of the wire.

After the wire 116 has passed through the surface treating line 110 and is coiled on the capstan 134, it is transported to the cold working line 140 which includes a lubricant applicator 144, a cold working tool 145, and a powered capstan 148 which pulls the wire 116 through the cold Working tool 146. A pay-off stand 141 supports the coil of the surface treated wire 116. The wire 116 passes through the lubricant applicator 144, through the cold working tool 146, wherein its cross-sectional area is reduced, and is taken up and coiled on the capstan 148 in a known manner. The cold working line 140 shown in FIG. 1 is configured as a cold drawing line, cold working tool 146 being embodied as a cold drawing die.

Figure 3:
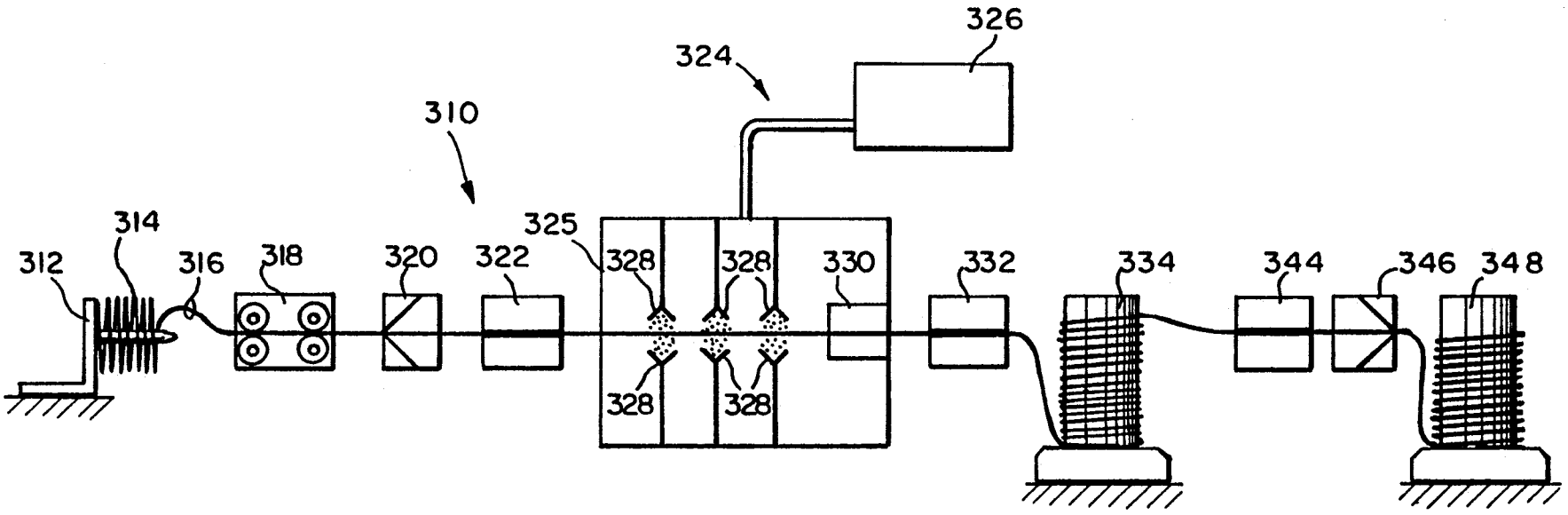
FIG. 3 is a schematic diagram of a second embodiment of the surface treating and cold working apparatus in accordance with the present invention.

Shown in FIG. 3 is a schematic representation of another embodiment of the apparatus for carrying out the method according to the present invention. The apparatus shown in FIG. 3 is a single processing line 310 including an optional roller die 318, a surface layer removal tool 320, an air wipe 322, surface texturing apparatus 324, lubricant applicator 332, a first capstan 334, a second lubricant applicator 344, a cold working tool 346, and a second capstan 348. Capstan 33 is powered and rotates to pull the wire 316 through the surface layer removal tool 320, the surface texturing apparatus 324, and the optional cold working tool 334. The second capstan 348 is also powered and rotates to pull wire 316 through the cold working tool 346.

In the single processing line 310 a pay-off stand 312 supports a coil 314 of steel alloy wire 316 which has been previously processed as by hot or cold rolling to an intermediate size or diameter. The wire 316 passes longitudinally through the optional roller die 318 and through the surface layer removal tool 320. The wire 316 then passes through the air wipe 322 which removes residual coolant from the wire surface. Upon exiting the air wipe 322, wire 316 enters the surface texturing apparatus 324 which is similar to that shown in FIG. 1 and described above. Upon exiting the surface texturing apparatus 324, the wire 316 passes through the lubricant applicator 332 and is coiled onto first capstan 334 in a known manner. If desired, an optional, intermediate cold working tool can be interposed between the lubricant applicator 332 and the first capstan 334 to provide an intermediate cold reduction of wire 316.

The wire 316 is then uncoiled from first capstan 334 and pulled through a second lubricant applicator 344, through the cold working tool 346, and is taken up and coiled on the second capstan 348 in a known manner. The first capstan 334 and the second capstan 348 are operated in coordination so that the tension on the wire 316 at any point in processing line 310 does not exceed the tensile yield strength of the wire 316.

The distinctive and beneficial nature of the matte textured surface provided by the process and apparatus according to the present invention will be better understood with reference FIGS. 4, 5, 6, and 7. Each of those figures is a photomicrograph at 100X of a partial, transverse cross section of a specimen of AISI Type 302 stainless steel wire. In each photomicrograph the lighter area is the wire material.

Figure 4:
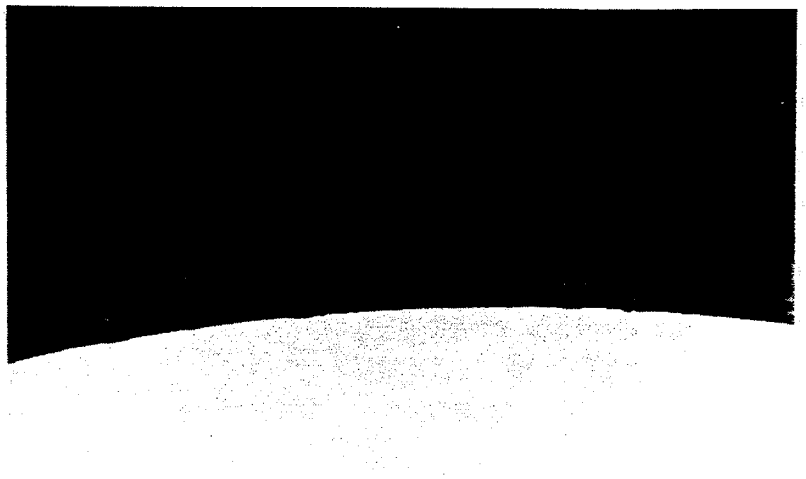
FIG. 4 is a photomicrograph at 100X showing a transverse section of a steel alloy wire that has been back-die shaved.
Figure 5:
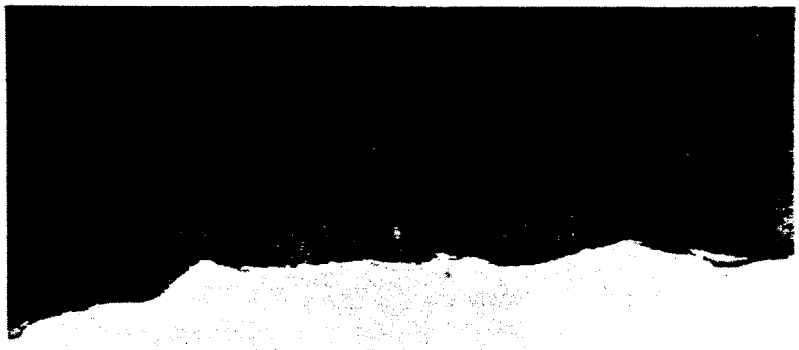
FIG. 5 is a photomicrograph at 100X showing a transverse section of a back-die shaved, steel alloy wire that has been blasted with metal shot.
Figure 6:
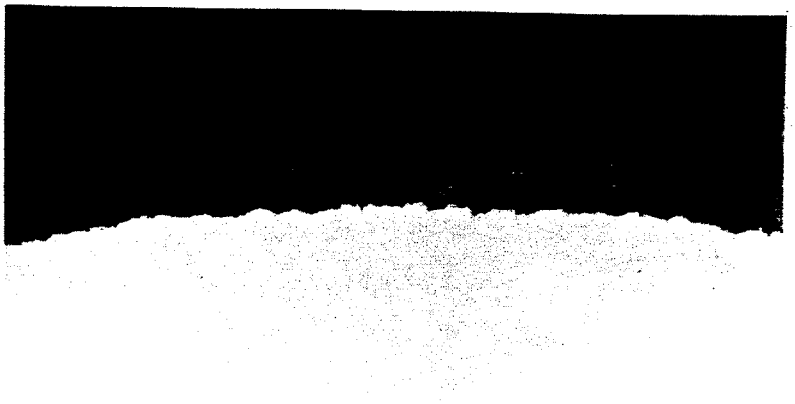
FIG. 6 is a photomicrograph at 100X showing a transverse section of a back-die shaved, steel alloy wire that has been annealed and acid cleaned.

FIG. 4 shows the surface profile of Type 302 wire which has been back-die shaved, but not further treated. The surface of the wire shown in FIG. 4 is very smooth and thus not very conducive to cold working because of its limited ability to carry lubricant into and through a cold working tool or die. FIG. 5 shows the surface profile of Type 302 wire which has been blasted with metal shot. The surface of the wire shown in FIG. 5 is very rough and jagged, and thus not very conducive to drawing or other cold working processes. Shown in FIG. 6 is a surface profile of Type 302 wire which has been annealed and acid cleaned after having been back-die shaved. FIG. 6 illustrates the undesirable intergranular attack at the wire surface that results from such processing.

Figure 7:
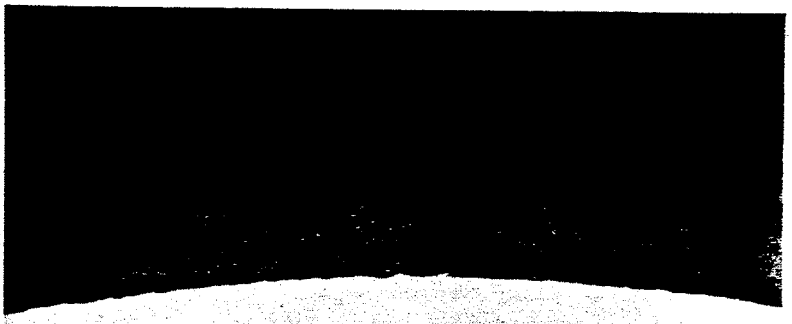
FIG. 7 is a photomicrograph at 100X showing a transverse section of a back-die shaved, steel alloy wire that has been surfaced-textured in accordance with the present invention.

FIG. 7 shows the profile of the surface of Type 302 wire that has been back-die shaved and then surface textured by glass bead blasting in accordance with the present invention. This surface is characterized by a plurality of random, minute, shallow indentations which significantly improve the lubricant carrying capability of the wire surface without measurable work hardening thereof. It has been found that this matte textured surface facilitates cold working of the wire to a significant degree.

It is apparent from the foregoing description and drawings that the process and apparatus according to the present invention provide a unique combination of advantages over the known techniques for surface treating and then cold working an elongated form of steel alloy. For example, the process according to this invention is readily adaptable to in-line processing with other surface treating and/or cold working operations to provide efficient, continuous processing of wire, rod, or bar. The process is capable of high processing line speeds, e.g., from at least about 300 fpm up to about 700 fpm, and possibly higher. The process is not limited to large diameter wire, rod, or bar and it does not measurably increase work hardening of the metal surface. Moreover, this process significantly improves the drawability and extrudability of peeled, shaved, or broached wire, rod, or bar while avoiding the physical and mechanical disadvantages of shot blasting and the chemical and environmental problems associated with acid treatments.

The terms and expressions that have been employed herein are used as terms of description and not of limitation. There is no intention in the use of such terms and expressions to exclude any equivalents of the features described or any portions thereof. It is recognized, however, that various modifications are possible within the scope of the invention claimed.

I claim:

1. A process for cold working an elongated form of a steel alloy comprising the steps of:

forming a smooth, reflective surface on the elongated form of steel alloy, including the step of removing at thin peripheral layer of material from the surface of the elongated form such that a new surface is exposed on the elongated form;

forming a matte texture on substantially all of the new surface of the elongated form, said matte texture comprising a plurality of random, minute, shallow indentation;

applying a lubricant to the elongated form such that the lubricant contacts the matte textured surface; and then cold working said elongated form.

2. The process of claim 1 wherein the step of cold working said elongated form comprises the step of reducing the cross-sectional area of said elongated form without removing material therefrom.

3. The process of claim 1 wherein the step of forming the matte texture on the surface of the elongated form comprises the step of propelling minute, nonmetallic, nonporous, spheroidal particles toward the elongated form such that sad nonmetallic, nonporous, spheroidal particles impinge on the surface of said elongated form.

4. The process of claim 1 wherein the step of forming the matte texture on the surface of the elongated form further comprises the step of passing the elongated form longitudinally through a high velocity stream of minute, nonmetallic, nonporous, spheroidal particles.

5. The process of claim 4 wherein the step of passing the elongated form longitudinally through the stream of minute, nonmetallic, nonporous, spheroidal particles further comprises the step of maintaining the elongated form under tension as it passes through the stream of particles.

6. The process of claim 5 wherein the stream of minute, nonmetallic, nonporous, spheroidal particles is propelled by a fluid at high pressure.

7. The process of claim 6 wherein the fluid is compressed air.

8. The process of claim 1 wherein the step of forming the matte texture on the surface of the elongated form comprises the steps of:

propelling a plurality of streams of minute, nonmetallic, nonporous, spheroidal particles toward the surface, each of said streams being angularly displaced from an adjacent stream around said elongated form so as to impinge on different portions of the surface of the elongated form, and passing the elongated form longitudinally through the plurality of streams of minute, nonmetallic, nonporous, spheroidal particles, whereby said nonmetallic, nonporous, spheroidal particles impinge on substantially the entire surface of said elongated form.

9. The process of claim 3 wherein said minute, nonmetallic, nonporous, spheroidal particles are about 100–170 mesh in size.

10. The process of claim 3 wherein said minute, nonmetallic, nonporous, spheroidal particles are glass beads.

11. The process of claim 10 wherein the glass beads are 100–170 mesh in size.

12. A process for treating the surface of an elongated form of a steel alloy to facilitate cold working of said elongated form, said process comprising the steps of:

forming a smooth, reflective surface on an elongated form of a steel alloy, including the step of removing an thin peripheral layer of material from the surface of the elongated form such that a new surface is exposed on the elongated form; and then forming a matte texture on substantially all of the new surface of the elongated form, said matte texture comprising a plurality of random, minute, shallow indentations, whereby the lubricant retention capability of the surface of the elongated form is significantly increased.

13. The process of claim 12 wherein the step of forming the matte texture on the surface of said elongated, steel alloy form comprises the step of propelling minute, nonmetallic, nonporous, spheroidal particles toward the surface of the elongated form such that said nonmetallic, nonporous, spheroidal particles impinge on substantially the entire surface of the elongated form.

14. The process of claim 12 wherein the step of forming the matte texture on the surface of the elongated form further comprises the step of passing the elongated form longitudinally through a high velocity stream of minute, nonmetallic, nonporous spheroidal particles.

15. The process of claim 14 wherein the step of passing the elongated form longitudinally through the high velocity stream of minute, nonmetallic, nonporous, spheroidal particles further comprises the step of maintaining the elongated form under tension as it passes through the particle stream.

16. The process of claim 12 wherein the step of forming the matte texture on the surface of the elongated form comprises the steps of:

propelling a plurality of streams of minute, nonmetallic, nonporous, spheroidal particles toward the surface, each of said streams being angularly displaced from an adjacent stream around said elongated form so as to impinge on different portions of the surface of the elongated form, and passing the elongated form longitudinally through a plurality of streams of minute, nonmetallic, nonporous, spheroidal particles, whereby said nonmetallic, nonporous, spheroidal particles impinge on substantially the entire surface of said elongated form.

17. The process of claim 12 wherein the step of removing the thin peripheral layer of material comprises pulling the elongated form through a tool that is formed to remove the thin peripheral layer; and the step of passing the elongated form longitudinally through the plurality of streams of minute, nonmetallic, nonporous, spheroidal particles comprises pulling the elongated form from said tool through the plurality of streams of nonmetallic, nonporous, spheroidal particles.

18. The process of claim 13 wherein said minute, nonmetallic nonporous, spheroidal particles are about 100–170 mesh in size.

19. An elongated steel alloy form that has been surface treated in accordance with the process of claim 12.

20. Steel alloy wire that has been surface treated in accordance with the process of claim 12.

21. Apparatus for treating the surface of an elongated form of a steel alloy to facilitate cold working of the elongated form, said apparatus comprising:

surface smoothing means for forming a smooth, reflective surface on the elongated form, said surface smoothing means including apparatus that is adapted to remove a thin, peripheral layer of material from the elongated, steel alloy form;

surface texturing means for forming a matte texture comprising a plurality of random, minute indentations on substantially all of the surface of the elongated form; and means for pulling the elongated, steel alloy form longitudinally through said surface smoothing means and said surface texturing means.

22. Apparatus as recited in claim 21 wherein said surface texturing means comprises:

a source of minute, nonmetallic, nonporous, spheroidal particles; and means for propelling a stream of cold nonmetallic, nonporous, spheroidal, particles toward the elongated form such that said particles impinge on the surface thereof.

23. Apparatus as recited in claim 21 wherein said surface texturing means is disposed between said surface smoothing means and said pulling means, whereby said elongated form is drawn through said tool and through said surface texturing means.

24. Apparatus as recited in claim 21 wherein said surface smoothing means and said surface texturing means are aligned on a common axis, and said pulling means is disposed for pulling the elongated form through said surface smoothing means and through said surface texturing means along said common axis, such that the elongated form is maintained under tension therethrough.

25. A process for treating the surface of an elongated form of a steel alloy to facilitate cold working of said elongated form, said process comprising the steps of:

forming a smooth, reflective surface on an elongated form of a steel alloy, including the step of bright strand annealing the elongated form; and then forming a matte texture on substantially all of the surface of the elongated form, said matte texture comprising a plurality of random, minute, shallow indentations, whereby the lubricant retention capability of the surface of the elongated form is significantly increased.

26. Apparatus for treating the surface of an elongated form of a steel alloy to facilitate cold working of the elongated form, said apparatus comprising:

surface smoothing means for forming a smooth, reflective surface on the elongated form, said surface smoothing means including a furnace for bright strand annealing said elongated form;

surface texturing means for forming a matte texture comprising a plurality of random, minute indentations on substantially all of the surface of the elongated form; and means for pulling the elongated, steel alloy form longitudinally through said surface smoothing means and said surface texturing means.

27. Apparatus as set forth in claim 26 wherein said surface smoothing means comprises apparatus for cold working said elongated form to reduce the cross-sectional area thereof without removing material therefrom.

* * * * *

UNITED STATES PATENT AND TRADEMARK OFFICE

CERTIFICATE OF CORRECTION

PATENT NO. : 5,277,048

DATED : January 11, 1994

INVENTOR(S) : LUBAS

It is certified that error appears in the above-indentified patent and that said Letters Patent is hereby corrected as shown below:

Column 5:

Line 17, "Wire" should be --wire--

Column 6:

Line 30, "cold working tool 145" should be --cold working tool 146--

Line 32, "Working" should be --working--

Line 49, "Capstan 33" should be --Capstan 334--

Claims:

Claim 1, line 11, "indentation" should be --indentations--

Claim 12, line 6, "an" should be --a--

Claim 22, line 5, "cold" should be --said--

Signed and Sealed this

Thirteenth Day of February, 1996

*Attest:*

Bruce Lehman

BRUCE LEHMAN

*Attesting Officer*

*Commissioner of Patents and Trademarks*